United States Patent [19]

Siggel et al.

[11] 4,164,603

[45] Aug. 14, 1979

[54] FILAMENTS AND FIBERS HAVING DISCONTINUOUS CAVITIES

[75] Inventors: Erhard Siggel, Lutzelbach; Gerhard Wick, Obernburg; Heinz Linhart, Erlenbach; Erich Kessler, Hochst, all of Fed. Rep. of Germany

[73] Assignee: Akzona Incorporated, Asheville, N.C.

[21] Appl. No.: 738,985

[22] Filed: Nov. 4, 1976

[30] Foreign Application Priority Data

Nov. 7, 1975 [DE] Fed. Rep. of Germany ..... 2550080

[51] Int. Cl.[2] ..... C08J 9/30; B29D 27/00

[52] U.S. Cl. ..... 428/398; 264/51; 264/53; 264/211; 521/79; 521/81; 521/182; 521/184

[58] Field of Search ..... 428/398; 264/41, 49, 264/53, 54, 51, 211; 260/2.5 E; 521/79, 81, 182, 184

[56] References Cited

U.S. PATENT DOCUMENTS

| | | | |
|---|---|---|---|
| 3,095,258 | 6/1963 | Scott | 264/209 |
| 3,627,867 | 12/1971 | Schwarz | 264/211 |
| 3,644,230 | 2/1972 | Cronin | 260/2.5 E |
| 3,907,963 | 9/1975 | Blackmon | 264/211 |
| 3,912,666 | 10/1975 | Spitzer et al. | 264/53 |
| 3,912,667 | 10/1975 | Spitzer et al. | 264/53 |
| 3,960,792 | 6/1976 | Nakamura | 260/2.5 E |
| 4,013,597 | 3/1977 | Granda et al. | 264/53 |

FOREIGN PATENT DOCUMENTS

| | | | |
|---|---|---|---|
| 103375 | 1/1974 | German Democratic Rep. | 264/53 |
| 6905110 | 10/1970 | Netherlands | 260/2.5 E |

*Primary Examiner*—Jay H. Woo

*Attorney, Agent, or Firm*—Francis W. Young; Jack H. Hall

[57] ABSTRACT

A filament of a thermoplastic synthetic polymer having a plurality of adjacent, separate discontinuous cavities is made by a process wherein a silicone oil and an inert gas or gas-forming substance are dispersed in a polymer melt, and the melt is extruded into a filament. The melt contains up to and including 1% by weight of the silicone oil, based on the weight of the melt, at the time it is extruded and up to and including 10% by weight of an inert gas.

19 Claims, 4 Drawing Figures

FILAMENTS AND FIBERS HAVING DISCONTINUOUS CAVITIES

Figures 1, 2, 3, 4:
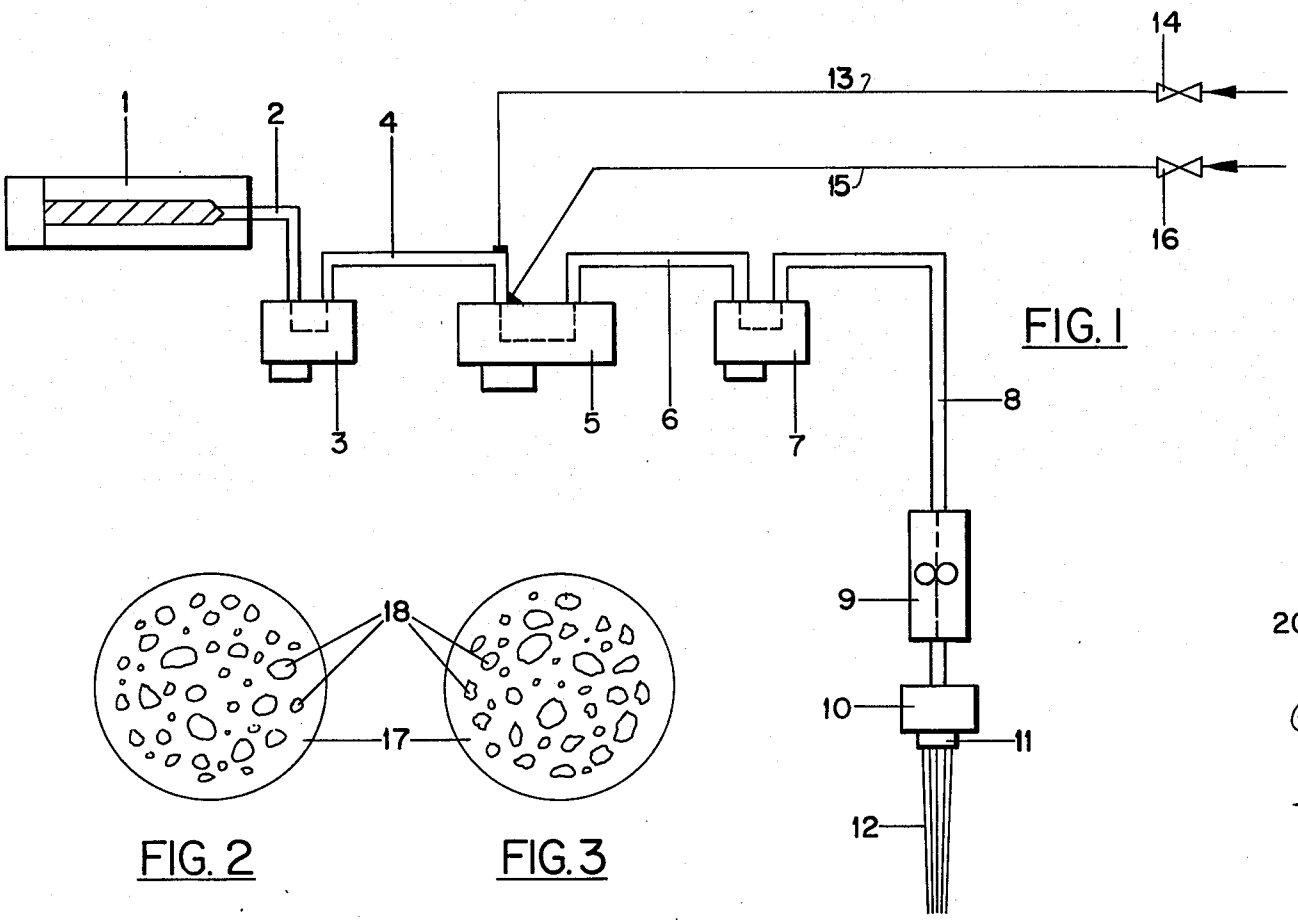

This invention relates to filaments and fibers of thermoplastic synthetic high molecular weight polymers having a plurality of adjacent, separate, discontinuous cavities therein and to a process for their manufacture.

The production of filaments or fibers containing cavities is known (German Pat. No. 346,830). The cavities in such filaments may be separate, i.e., bounded on all sides by walls within the filament and may occur in a variety of shapes and sizes. For example, they may be very small and impart a microporous structure to the fiber. Alternately, the cavities may be of large dimensions and form a microporous structure.

Furthermore, hollow filaments are known in which the cavities therein are continuous. In most cases these filaments simply have a continuous cavity or bore, so that the cavity represents, so to say, a hollow core of the filament and the polymer mass from which the filament is made forms the surrounding wall or covering.

Filaments with cavities and the processes for their manufacture known up to now exhibit a series of drawbacks. The uniformity of the cavities in known filaments is unsatisfactory (German Patent application No. 1 669 365), so that the filaments have different strengths, which may lead to difficulties in processing them. Moreover, known processes for the manufacture of such filaments can only be controlled with difficulty and frequently will only lead to serviceable filaments after complicated processing techniques.

An object of the invention is to provide synthetic filaments having cavities therein which are devoid of the foregoing disadvantages. Another object of the invention is to provide synthetic filaments having cavities which are substantially uniform in diameter and are substantially uniformly distributed along the length of the filament and which filaments are easily processed for various applications. Still another object of the invention is to provide synthetic filaments having cavities therein which are adapted to be drawn and, after drawing have sufficient tenacity for various applications. A still further object of the invention is to provide a technically suitable process for making synthetic filaments which permits high spinning speeds and trouble-free operation over long periods of time. A more specific object of the invention is to provide a technically simple and practical process for making at least partially hollow synthetic polymer filaments with known spinning equipment used to make conventional non-porous filaments without substantial adjustment or modification of spinning conditions.

Other objects of the invention will become apparent from the following description with reference to the accompanying drawing wherein FIG. 1 illustrates schematically one embodiment of an apparatus for practicing the process of the invention;

FIGS. 2 and 3 illustrate in cross-sections embodiments of the filaments of the invention which are circular in cross-section and have a plurality of adjacent, separate discontinuous cavities; and FIG. 4 illustrates in cross-section one embodiment of a filament of the invention which is trilobal in cross-section.

It has now been found, surprisingly, that filaments of thermoplastic synthetic high molecular weight polymers with a plurality of adjacent, separate, discontinuous cavities can be obtained very advantageously by melting the polymer, mixing the melt with a gas or gas-forming substance, and extruding the polymer melt which has been mixed with a gas or a gas-forming substance, through spinnerets, provided that the melt is mixed with up to and including 1 weight % silicone oil, based on the weight of the melt, and with a gas that is substantially inert to the melt, or an inert, gas-forming substance under conditions whereby the gas or gas-forming substance is largely dissolved or finely dispersed in the melt, whereby the volume constituent of the gas is less than 10%, preferably less than 5%, based on the total volume of the melt.

It is especially advantageous, when the polymer is melted with a single screw extruder, to add the silicone oil at a point between the extruder and a spinning pump preceding the spinneret.

The polymer may, of course, also be melted in other devices such as a multi-screw extruder or a simple melting grid.

It is expedient to locate a pressure pump after the melting device, and that the mixing of the silicone oil and of the essentially inert gases or inert gas-forming substances be accomplished behind this pressure pump and before a pressure or spinning pump preceding the spinneret.

A mixer can be provided between the melting device and spinneret. In such case, the silicone oil and the gas or gas-forming substance can then, for example, be added directly into the mixer.

The viscosity of the silicone oil being used may vary within relatively wide limits. Preferably, however, silicone oils of a viscosity between 3 to 400 cP are used. It has been found advantageous to use silicone oils of a viscosity of 3 to 50 cP which are not stabilized. Not being stabilized implies that no conventional stabilizer has been added to them. Silicone oils of a viscosity of 50 to 400 cP are preferably used in stabilized form. Cerium compounds were found especially suitable as a stabilizer. Suitable cerium compounds are, for example, cerium sulfate and cerium salts of organic acids. Also suitable are cerium compounds having a chelate structure, for example, cerium acetylacetonate.

An especially advantageous stabilizer for the silicone oil is the product obtained by reaction of cerium acetylacetonate with methylsiloxanes containing a reactive hydrogen atom.

Silicone oils in amounts of about 1 weight % or less, based on the weight of the melt, are used. Preferably, use is made of 0.1 to 0.4 weight % silicone oil, whereby the preferred range, for example, with polyethylene terephthalate being the polymer, is 0.1 to 0.3 weight % and with polycaprolactam, 0.2 to 0.4 weight %.

In some cases it may be expedient to use a silicone oil containing one or more nucleating agents. Nucleating agents are understood to be solid substances which aid the formation of cavities during the spinning process. Finely grained substances, such as titanium dioxide, kaolin, talcum, silica gel and others can be used as nucleating agents. To insure a proper, uniform distribution of the nucleating agents in silicone oil, it is necessary that these be finely dispersed in the latter. To obtain a favorable distribution of the nucleating agent, it may be advantageous to add ethoxylated dimethylsiloxane to the silicone oil. In a particularly advantageous version of the process according to the invention, use is therefore made of silicone oils containing nucleating agents and, additionally, up to 10% ethoxylated dimethylsiloxane.

Silicone oils are well known chemical compounds of the silicone group, also referred to as organosiloxanes. They represent substances whereby the silicon atoms are partly bonded by oxygen atoms with the remaining valences of the silicon being saturated by hydrocarbon residues. Silicone oils are clear, colorless liquids having a predominantly linear structure. Detailed information on silicone oils can, e.g., be obtained from Roempp Chemie-Lexikon, Franck Publications, Stuttgart, 1966 or Ullmanns Encyclopaedie der technischen Chemis, 3rd Edition, Vol. 15, pp. 769 ff., Urban and Schwarzenberg, Munich-Berlin 1964, the disclosure of which is incorporated hereby by reference.

Particularly advantageous within the scope of the invention are silicone oils based on dimethylpolysiloxanes. These may be represented by the chemical formula

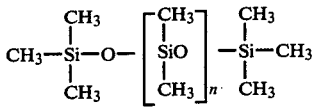

wherein n is between 2 and 200, preferably between 2 and 60.

It is expedient to use silicone oils of maximum purity. To this end, they can, for example, be distilled. Silicone oils frequently still contain basic or acid impurities resulting from the manufacturing process. In the presence of such impurities, chemical repurification or so-called deactivation is recommended. This can be accomplished, for example, by means of carbon dioxide or amphoteric aluminum hydroxide. Details of such deactivation are described by Kucera et al in J. Polymer Sci. 54, 375–84 (1961) and 59, 79–85 (1962), incorporated herein by reference.

Instead of polysiloxanes containing primarily methyl groups, compounds wherein the methyl group is replaced by other groups, such as the phenyl group may be used. Silicone oils with a phenyl to methyl group ratio of 1:18 to 1:12 were found expecially suitable.

The gas, which is mixed into the melt, should be substantially inert towards the melt, i.e., it should not react with the polymer forming the melt. Any suitable inert gas may be used such as nitrogen, carbon dioxide, argon, and the like.

The quantity of gas to be mixed with the melt can vary within relatively wide limits. However, care should be taken that the gas is mixed with the melt under conditions whereby the gas is largely dissolved or finely dispersed in the melt, and whereby the volume constituent of gas is less than 10%, preferably less than 5%, based on the total volume of the melt. The melt conditions which effect the gas dispersion are essentially, the temperature and the pressure. By increasing the amount of gas being added, the density of the produced filament is lowered. Hence, it is possible in this manner to vary the density of the filament being formed within relatively wide limits by controlling the addition of gas. The quantity of added gas can be varied, for example, by modifying the pressure at which the gas is introduced into the melt; the pressure or the detention time of the melt at the gas injection point.

The density of the filament can also be changed by injection of different gases.

Another possibility to vary the density of the filaments is provided by using as inert gas, a mixture of two or more gases and thereby varying the component of individual gases in the gas mixture. It is particularly easy in this manner to obtain specific densities, by maintaining constant all other conditions such as pressure, temperature, transport speed, detention time in the mixer, etc., and by only changing the proportion of one gas in the injected gas mixture. For example, by using carbon dioxide-nitrogen mixtures, suitable densities can be very advantageously adjusted. It is also possible to inject two or more gases at points located one behind the other.

For trouble-free production of textile filaments having good drawing characteristics, densities in the case of polyethylene terephthalate may, for example, be between 1.18 and 1.22 g/cc using $CO_2$, 1.1 g/cc using $N_2$, 1 g/cc using chlorofluorohydrocarbon, and 1.15 g/cc using argon. Lower densities can be obtained for heavier filaments, also for polycaprolactam.

The invention also contemplates using gas-forming substances as part or all of the cavity forming material. Especially suitable within the framework of the invention are organic solvents. These substances, like the added gas, form cavities in the yarn as the melt emerges from the spinning plate. Gas-forming substances that can be used include, among others, low-boiling hydrocarbons, such as pentane, hexane; also suitable are, for example, hydrocarbons like propane or butane which are already gaseous at room temperature. Eminently suitable are halogenated paraffins like tetrachlorofluoroethane and others.

The silicone oil and the gases or gas-forming substances are best added at high pressure, for example, at 50 to 200 bar.

Melts of linear, fiber-forming polyesters, like polyethylene terephthalate, and melts of fiber-forming polyamides, like nylon 6 and nylon 66, can very advantageously be processed within the framework of the invention. However, the process according to the invention can also be applied, largely without problems, to other spinnable thermoplastic polymers.

The use of silicone oils in the preparation of filaments with cavities is known. East German Pat. No. 103,375, Example 1, describes the wetting of isotactic polypropylene with 0.05 weight % silicone oil, which is then thoroughly mixed with 0.16 weight % sodium hydrogen carbonate, and 0.12 weight % citric acid. The purpose of the silicone oil here is obviously to improve the gliding properties of the polypropylene in the extruder, and possibly also to enable it to function to a certain extent as a plasticizer. However, in contrast with the invention, the silicone oil is added in very small quantities to the chips and not to the melt. The advantages of the instant invention cannot be realized in the manner described in this example. Merely a slight increase in the silicone oil content, when duplicating the cited example, inhibits unobjectionable processing of the chips.

U.S. Pat. No. 3,095,258 describes the use of polysiloxanes as gas-forming substances. According to the U.S. patent, this does not provide for a plurality of adjacent, separate, discontinuous cavities, but for a single cavity surrounded by a polymer mantle. Silicone oil alone, even with modification of the spinning conditions, for example, using a circular orifice spinning plate without a pin, will not produce suitable filaments with a plurality of uniform cavities.

The filaments or fibers contemplated by this invention are thermoplastic synthetic high polymers with a plurality of adjacent, separate, discontinuous cavities, characterized by a content of up to and including 1% silicone oil finely distributed in the polymer, as well as by a cavity constituent of 5 to 50 volume %, based on the total volume of the filament or fiber covered by the outer shell of the filament.

Filaments and fibers of polyethylene terephthalate, according to the invention, contain preferably 0.1 to 0.3 weight % silicone oil. Useful filaments and fibers of polycaprolactam contain preferably 0.2 to 0.4 weight % silicone oil.

The cavities are distributed very uniformly throughout the filament and are present as a plurality of adjacent, separate, discontinuous cavities. Cross-sections of the filaments according to the invention show that most of the cavities, preferably more than 50%, are nearly circular or round and that angular or uneven shapes are largely absent. The diameter of a single cavity is partly dependent upon the denier of the filament being made, but also on the number of individual cavities and the amount of gas in the melt. As a rule, the diameter of the cavities in drawn filaments of textile denier is between about 0.2 and 6 microns, whereby the cavities determining the properties of the filaments according to the invention have a diameter of about 1 to 4 microns. The length of such cavities depending upon the diameter is generally between about 0.3 and 6 mm.

Filaments with a plurality of very uniform, separate, nearly needle-shaped cavities are obtained very easily according to the process of the invention. These cavities exhibit no irregularities, so that the filaments have excellent further processing properties. Very high drawoff rates can be achieved, for example, 3,500 meters per minute, thus production rates readily managed in the production of conventional filaments. The maximum drawability of the filaments is only slightly below that of conventional filaments without cavities. It will naturally decline with increasing cavity content.

The melts to which silicone oil and gas or gas-forming substances are added according to the invention can be transported over relatively extensive travel zones without disintegrating or bubble formation interfering with the spinning process. This is especially important when the melt must be transported from a central mixer over a number of distributors and long melt lines to a plurality of spinning pumps.

Conventional spinnerets can be used to spin these filaments. No special treatment is needed as the filaments emerge from the spinning plate, such as, e.g., quenching in a water bath after a short period of time. Normal melt spinning processes can be used, for example, as employed in the production of polyester or polyamide filaments, e.g., by spinning via a conventional spinning chimney. It is thus possible to produce filaments with cavities according to the invention on existing spinning equipment without substantial modification of the latter. Conventional spinning conditions can also be substantially retained; slight deviations, for example, a slightly higher melt throughput per spinneret orifice is possible. Also, an increase of the melt pressure in front of the spinneret orifice can be obtained by reducing the diameter of the spinning orifice.

Surprisingly, spinneret running times are very high with the process according to the invention. With known processes for the production of filaments with cavities, the spinning operation must be interrupted at relatively short intervals, since the filaments break or the spinnerets begin to drip.

After malfunctions of this type, the spinnerets must be scraped and resprayed with a finish. Running times are substantially higher with the process according to the invention, so that even the so-called scraping cycle can be extended, amounting in general to at least 8 hours. Scraping cycle refers to the time after which a spinneret is regularly scraped and new finish applied, whereby as a rule silicone-containing finishes are used. The longer spinneret running times with the process according to the invention, is probably attributable in part to the silicone content of the melt.

Based on the cavities essential according to the invention, the filaments of the invention have a very high covering power and a low density. They can be dyed by conventional dyeing methods.

The favorable water retention capacity of the filaments should be emphasized, inasmuch as they are especially suitable for wearing apparel, where the absorption of moisture such as perspiration is important.

The water retention capacity, also referred to earlier as swelling index, can be determined by saturating the material to be investigated with a wetting agent and then by centrifuging under precisely defined conditions. The centrifuged specimen is then weighed, dried, and weighed again. The difference between the two weights represents the water retained by the sample after centrifuging. Further details are given by Stefan Kleinheins, in "Textile Pruefungen" Enka Glanzstoff AG, Textile Technical Institute, Obernburg, Issue 1973.

Referring now to the drawing, the spinning apparatus shown in FIG. 1 like conventional spinning equipment, is made up of standard elements such as a melting device 1, here in the form of an extruder, but which could also be a melting grid, a first pressure pump 3, a second pressure pump 7 and a spinning head 10, and additionally may also contain a likewise conventional metering or spinning pump 9.

To carry out the process according to the invention, additional conduits 13, 15 with regulating devices 14, 16 are required to feed the inert gas or the inert gas-forming substance and the silicone oil to the melt. Feeding of the silicone oil, inasmuch as a single screw extruder is used, is more expediently accomplished after the extruder pressure has built up, since, especially when adding more than about 0.1 weight % silicone oil, the transportation effect of the screw declines. Therefore, the silicone oil is expediently added between extruder and pressure pump 7 or spinning pump 9 located before spinning head 10. Conversely, the inert gas or inert gas-forming substance should preferably be added between two pressure locks acting on melting device 1 and spinning head 10. In the example shown in FIG. 1, pressure pump 3 or 7 act as a pressure lock with respect to melting device 1 or spinning head 10, so that the inert gas or the inert gas-forming substance is added preferably between these two pressure pumps 3, 7.

To insure a maximum of homogeneity in mixing the gas or gas-forming substance and silicone oil (the sequence of addition is in principle immaterial) with the melt, a mixer 5 is also provided. The latter is advantageously located between the two pressure pumps 3, 7, whereby lines 13, 15 may lead into melt line 4 located between pressure pump 3 and mixer 5, or immediately into mixer 5.

With the version shown in FIG. 1, the process according to the invention would be carried out substantially as follows.

Polymer chips are melted in melting device 1, a conventional single screw extruder in this case. The melt at a pressure of, for example, about 70 bar travels via the first pressure pump 3, where its pressure is brought to about 40 to 80 bar, to melt line 4. By means of regulating unit 14, for example, a piston metering pump operating at very low throughputs, the required quantity of silicone oil is introduced via line 13 into melt line 4, with addition via line 15 of, for example, gaseous nitrogen whose pressure and volume (a few cc/g of melt measured at standard conditions) is regulated via regulating unit 16. The gas is introduced under pressure and temperature conditions, whereby it is largely dissolved or dispersed in the melt. The mix composed of melt, silicone oil and gas or gas-forming substance is extensively homogenized in mixer 5, which is, for example, a pin mixer operating at 150 to 200 rpm or a static mixer having about 20 to 30 mixer elements, and then transported via melt line 6 to the second pressure pump 7. From there the melt, including the components that are dissolved or mixed in it, is led via melt line 8 and, as the case may be, via a metering or spinning pump 9 to spinning head 10. Filaments 12 emerge from spinneret 11 which, due to the pressure reduction occurring on emergence from the spinneret, contain a plurality of spherical gas inclusions, substantially uniformly distributed over the yarn cross-section and yarn length. As a result of the spinning stretch, these cavities assume a needle shape. The undrawn filaments wound on a winding device (not shown) which may operate at speeds up to 3,500 mpm, exhibit, as do the drawn filaments, a plurality of adjacent or end-to-end, separate, discontinuous cavities assuming a needle shape.

It is obvious that melt line 8, behind the second pressure pump 7, or behind the metering or spinning pump 9, can be branched in a known manner; in other words, that the melt mixed with silicone oil and gas or gas-forming substance can be supplied from a central mixer 5 via distribution lines, not only to one spinning head having, for example, 1 to 8 spinnerets, but simultaneously 4, 8, 16, 32, 48 or more spinning heads provided in, e.g., a spinning beam.

It is also possible to use instead of the central mixer, individual spinning heads, each provided with its own small mixer, which insures that before the melt reaches the spinning head, the silicone oil and gas or gas-forming substance are homogeneously distributed in the melt. A novel chain mixer, as described in German Patent application No. P 25 50 069.0 Filed Nov. 7, 1975 which can be combined with the spinning pump is eminently suited for this.

FIGS. 2, 3 and 4 illustrate examples of the filaments according to the invention, or produced according to the invention. FIGS. 2 and 3 illustrate filaments 17 with substantially circular cross-section. This scale drawing of an individual filament of about 3.3 dtex (sections obtained at intervals of a few cm) indicates that in contrast to the state-of-the-art the filaments have a cross-section closely resembling the profile of the spinneret's orifice, and above all a substantially whole outer covering, whereby the needle-shaped cavities 18 are uniformly distributed over the cross-section and exhibit a relatively narrow diameter distribution, within the range of, e.g., 1 to 6 microns for individual filament deniers of 3.3 dtex. Particularly large gas inclusions were not observed in the filaments according to the invention. This explains the good spinning and drawing characteristics of the filaments according to the invention. The cross-sections of cavities 18 are essentially circular.

As suggested by FIG. 4, in addition to filaments of circular cross-section, filaments with different cross-sections, e.g., rectangular, square, pentagonal, or polygonal, oval, trilobal, or multilobal cross-sections can be obtained according to the invention. The example illustrates an individual filament 19 having a trilobal cross-section, disclosing here, too, a plurality of separate, needle-shaped cavities 20, of substantially circular cross-section.

EXAMPLE 1

A single point extruder spinning machine, schematically illustrated in FIG. 1, is used to spin filaments according to the invention from polycaprolactam chips of a solution viscosity of 2.72, measured as a 1 weight % solution in 90% formic acid at 25° C. The melt emerges from the extruder at a pressure of about 100 bar via the first pressure pump. In the melt line to the mixer, including a shaft provided with radially aligned pins as mixing elements, the melt at a temperature of about 278° C. is mixed via a piston melting pump with about 0.3 weight %, based on the weight of the melt, of a dimethylsiloxane (20 cP at 20° C.) and nitrogen at about 117 bar supplied from a $N_2$ bottle at a pressure of 150 bar via a regulating valve and a VA-capillary of a diameter of 0.7 mm. The mixer operates at a speed of about 180 rpm. The second pressure pump runs at a slightly higher rpm than that of the first pressure pump, and transports the largely homogenized mixture of melt, silicone oil, and nitrogen contained in the melt, to the metering pump located some 1.80 meter away, whence it is fed to the spinning head and extruded from a spinneret having 22 spinning orifices of 0.14 mm diameter. At a throughput of about 23 g/min, the filaments are wound at a rate of about 1100 meters per minute. The spinning point operated over a period of several days virtually trouble free with a scraping cycle of about 6 to 8 hours.

The filaments spun under these conditions were subsequently drawn to a ratio of 1:2.52 under conventional conditions. They exhibit a strength of 33 cN/tex and a water retention capacity of 25%. The effective denier is dtex 78 f 22. The density of the filaments is 1.0 g/cc corresponding to a cavity component of about 12%.

The cross-section of the drawn filaments according to the invention is essentially circular, has on the average some 12 to 18 cavities of a diameter of 1 to 2 microns, about 3 cavities of a diameter of 2 to 3 microns and occasionally (about 2) cavities of a diameter of 4 to 6 microns. Larger diameters were not observed. The surface of the filament is essentially smooth, i.e., there are practically no "burst" cavities. Cavities having a diameter of less than 1 micron have not been included in the count.

EXAMPLE 2

Using the same spinning equipment as in Example 1, polyethylene terephthalate chips of a solution viscosity of 1.82, measured as a 1 weight % solution in m-cresol at 25° C. are melted and the melt at a pressure of about 100 bar is transported from the extruder to the first pressure pump. From there it is fed to the mixer. On the way, it is mixed via a piston metering pump with about 0.18 weight % dimethylsiloxane (viscosity at 20° C. = 20 cP) based on the weight of the melt. Via a second, cooled piston metering pump, liquid carbon dioxide is simultaneously added through a 2500 mm long VA-capillary of 0.7 mm diameter, where it evaporates. Close to the mixer the capillary feeds into the melt line. The gas pressure is about 130 bar.

The mixture of melt, silicone oil, and carbon dioxide is transported via the second pressure pump and the metering pump to the spinning head, and from there extruded through a spinneret having 24 spinning orifices of 0.15 mm diameter. At a throughput of about 30 g/min, the filaments are spun at an exit speed of about 59 m/min and wound at about 1200 mpm. Such a spinning point worked six days without trouble and a scraping cycle of about 4 to 8 hours.

Filaments spun under these conditions were hot-drawn under conventional conditions. Drawing ratio=1 to 3.25. The drawn filaments had a strength of 34 cN/tex, and effective denier of dtex 76 f 24. The density of the filaments was 1.13 g/cc, corresponding to a cavity constituent of about 18%.

Disregarding cavities of a diameter of less than 1 micron, the drawn filaments contained on the average some 30 to 40 cavities, whereby, as in the filaments according to Example 1, diameters of 1 to 2 microns are in the majority, those of 2 to 3 microns frequent and those of 4 to 6 microns occur occasionally.

Here as well there are practically no burst surface areas in the filaments.

EXAMPLE 3

The equipment used in Examples 1 and 2 is modified to the extent that the second pressure pump supplies an 8-point spinning device; in other words, the mixture of melt, silicone oil, and gas is fed via a dual melt line to 2 pump blocks, each with 2 double spinning pumps, which together feed 8 pot spinnerets of a diameter of 64 mm.

Polyethylene terephthalate chips of a solution viscosity of 1.63, delustered with $TiO_2$, are melted in the extruder. The melt is fed at a pressure of 100 bar to the first pressure pump and then to the mixer. On the way, the melt is mixed by means of a piston metering pump with 0.16 weight %, based on the weight of the melt, dimethylsiloxane (20 cP at 20° C.) and from an $N_2$ bottle at a pressure of 150 bar, via a regulating valve and a VA capillary of 0.7 mm diameter, with nitrogen at a pressure of about 117 bar.

On leaving the mixer, the melt with silicone oil and nitrogen is fed to a spinning plate provided with 24 orifices of 0.15 mm dia. At a throughput of 30 g/min the filaments are spun at a delivery speed of about 50 m/min. Winding speed=1200 mpm. The unit works for a prolonged period of time without difficulty and with a scraping cycle of 12 hours.

The filaments spun in this manner are hot-drawn conventionally at a draw ratio of 1:3.28. The drawn filaments have a strength of about 21 cN/tex, and effective denier of dtex 76 f 24 and a density of 1 g/cc, corresponding to a cavity constituent of 27.5%.

The filaments provided by this invention may be used to advantage in making mat material for use as filters, for reinforcing plastics, as an upholstery material or the like as disclosed in our copending application Ser. No. 738,986 filed on Nov. 4, 1976, the disclosure of which is incorporated herein by reference.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A process for the manufacture of filaments or fibers from a thermoplastic synthetic polymer having a plurality of adjacent, separate, discontinuous needle-shaped cavities of substantially uniform size which comprises melting the synthetic polymer, having the resulting melt with from 0.1% up to and including 1% by weight of a dimethylpolysiloxane having a viscosity of from 3–400 cP based on the weight of the melt, and 10% or less by volume, based on the gas volume of the melt, of a gas or its equivalent of a gas-forming substance which is substantially inert to the melt under conditions whereby the gas or gas-forming substance is dissolved or finely dispersed in the melt, and extruding the resulting mixture through spinnerets to form filaments wherein said cavities comprise 5–50% of the volume of said filaments.

2. The process of claim 1 wherein about 5% by volume or less gas or its equivalent of a gas-forming substance is mixed with the melt.

3. The process according to claim 1 wherein the polymer is melted in a single screw extruder and the polysiloxane is added between the extruder and a spinning pump preceding the spinneret.

4. The process according to claim 1 wherein the polysiloxane and the substantially inert gas or inert gas-forming substance is supplied behind a pump located after the melting device and before a spinning pump located in front of the spinneret.

5. The process according to claim 1 wherein the polysiloxane and the gas or gas-forming substance are supplied to a mixer located between the melting device and spinneret.

6. The process according to claim 2 wherein from 0.1 to 0.4 weight % polysiloxane is used.

7. The process according to claim 6 wherein an unstabilized polysiloxane of a viscosity of 3 to 50 cP is used.

8. The process according to claim 6 wherein a stabilized polysiloxane of a viscosity of 50 to 400 cP is used.

9. The process according to claim 8 wherein said polysiloxane is stabilized with a cerium compound.

10. The process according to claim 1 wherein the polysiloxane contains one or more nucleating agents.

11. The process according to claim 10 wherein the polysiloxane contains additionally an ethoxylated dimethylsiloxane.

12. The process according to claim 1 wherein the polysiloxane is deactivated.

13. The process according to claim 1 wherein a mixture of two or more gases is used as the inert gas.

14. The process according to claim 13 wherein one inert gas is an organic solvent.

15. The process according to claim 13 wherein a fluorohydrocarbon is one of the gas-forming substances.

16. The process according to claim 1 wherein the melt is a linear, fiber-forming polyester.

17. The process according to claim 1 wherein the melt is a fiber-forming polyamide.

18. A process for making a synthetic polymer filament having a plurality of needle shaped non-communicating cavities enclosed in a substantially smooth uninterrupted shell which comprises mixing a dimethylpolysiloxane with a polymer melt in an amount of 0.1% to 1% by weight based on the weight of the melt and a substance which is a gas when the melt is extruded in an amount of up to and including 10% by volume gas, based on the volume of the melt, under conditions whereby the gas is substantially uniformly dispersed in the melt and extruding the resulting mixture into a filament.

19. The product of the process of claim 18.

* * * * *

UNITED STATES PATENT OFFICE

CERTIFICATE OF CORRECTION

Patent No. 4,164,603 Dated August 14, 1979

Inventor(s) Erhard Siggel, Gerhard Wick Heinz Linhart and Erich Kessler

It is certified that error appears in the above-identified patent and that said Letters Patent are hereby corrected as shown below:

In Claim 1 at column 10, line 10, change "having" to read --mixing--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*